US011394121B2

(12) United States Patent
Farkas

(10) Patent No.: US 11,394,121 B2
(45) Date of Patent: Jul. 19, 2022

(54) NONPLANAR COMPLEMENTARY PATCH ANTENNA AND ASSOCIATED METHODS

(71) Applicant: Isolynx, LLC, Haverhill, MA (US)

(72) Inventor: Alexander T. Farkas, Chatham, MA (US)

(73) Assignee: Isolynx, LLC, Haverhill, MA (US)

( * ) Notice: Subject to any disclaimer, the term of this patent is extended or adjusted under 35 U.S.C. 154(b) by 0 days.

(21) Appl. No.: 16/663,749

(22) Filed: Oct. 25, 2019

(65) Prior Publication Data

US 2020/0144724 A1 May 7, 2020

Related U.S. Application Data

(60) Provisional application No. 62/754,211, filed on Nov. 1, 2018.

(51) Int. Cl.

| | |
|---|---|
| ***H01Q 9/04*** | (2006.01) |
| ***H01Q 1/27*** | (2006.01) |
| ***H01Q 5/25*** | (2015.01) |
| ***H01Q 1/48*** | (2006.01) |

(52) U.S. Cl.

CPC ..... *H01Q 9/0471* (2013.01); *H01Q 1/273* (2013.01); *H01Q 1/48* (2013.01); *H01Q 5/25* (2015.01)

(58) Field of Classification Search

CPC ..... H01Q 5/25; H01Q 9/0407; H01Q 9/0471; H01Q 21/065; H01Q 21/205

See application file for complete search history.

(56) References Cited

U.S. PATENT DOCUMENTS 3,868,694 A * 2/1975 Meinke ..... H01Q 9/40 343/753
3,978,488 A * 8/1976 Kaloi ..... H01Q 9/0407 343/829
5,598,168 A * 1/1997 Evans ..... H01Q 9/0407 343/700 MS (Continued)

FOREIGN PATENT DOCUMENTS

WO WO 2017/095711 6/2017
WO WO 2018/013658 1/2018

OTHER PUBLICATIONS

PCT/US2019/58020 International Search Report and Written Opinion dated Mar. 3, 2020, 9 pp.

*Primary Examiner* — Ab Salam Alkassim, Jr.
(74) *Attorney, Agent, or Firm* — Lathrop GPM LLP

(57) ABSTRACT

A nonplanar tracking tag includes a nonplanar complementary patch antenna having an antenna ground plane, a first antenna patch lying in a first plane forming a first angle with the antenna ground plane, and a second antenna patch lying in a second plane forming a second angle with the antenna ground plane. The patch antenna may be formed on a flexible circuit and electrically coupled to a transceiver. The tracking tag may also include a dielectric material shaped and sized to position the first and second antenna patches, when the flexible circuit is wrapped around the dielectric material, in the first and second planes. Advantageously, the radiation pattern produced by the nonplanar complementary patch antenna is biased away from a normal axis of the tracking tag, and therefore can communicate efficiently with receivers when the tracking tag is oriented with its normal axis pointing away from the receivers.

15 Claims, 12 Drawing Sheets

(56) References Cited

U.S. PATENT DOCUMENTS 5,633,646 A * 5/1997 Strickland ..... H01Q 1/38 343/700 MS
5,734,350 A * 3/1998 Deming ..... H01Q 1/42 343/846
5,988,583 A * 11/1999 Rhine ..... H01Q 1/1207 248/523
6,236,367 B1 * 5/2001 Du Toit ..... H01Q 9/0428 343/700 MS
8,217,849 B2 * 7/2012 Sardariani ..... H01Q 9/26 343/793
9,065,166 B2 * 6/2015 Ng ..... H01Q 13/106
10,312,583 B2 * 6/2019 Ng ..... H01Q 21/28
10,446,934 B2 10/2019 Farkas
2003/0122712 A1 * 7/2003 Rawnick ..... H01Q 9/0407 343/700 MS
2004/0070536 A1 * 4/2004 Stotler ..... H01Q 9/0471 343/700 MS
2004/0174303 A1 * 9/2004 Duxbury ..... H01Q 1/246 343/700 MS
2006/0145929 A1 * 7/2006 Teng ..... H01Q 9/0407 343/700 MS
2006/0187123 A1 * 8/2006 Ando ..... H01Q 9/0414 343/700 MS
2006/0273976 A1 * 12/2006 Wang ..... H01Q 9/285 343/795
2008/0252543 A1 * 10/2008 Pettus ..... H01Q 1/38 343/793
2010/0007570 A1 * 1/2010 Sardariani ..... H01Q 9/285 343/797
2012/0235881 A1 * 9/2012 Pan ..... H04B 7/0413 343/893
2013/0021207 A1 * 1/2013 Lee ..... H01Q 1/38 343/700 MS
2013/0241778 A1 * 9/2013 Orime ..... H01Q 15/006 343/700 MS
2014/0132474 A1 * 5/2014 Guan ..... H01Q 5/50 343/862
2016/0226154 A1 * 8/2016 Chang ..... H01Q 21/0075
2018/0019513 A1 * 1/2018 Farkas ..... H01Q 1/273
2018/0269584 A1 * 9/2018 Farkas ..... H01Q 9/46
2019/0288371 A1 * 9/2019 Kamgaing ..... H01L 23/3128
2020/0021011 A1 * 1/2020 Cooper ..... H01Q 21/065
2021/0359423 A1 * 11/2021 Huang ..... H01Q 21/0025

* cited by examiner

NONPLANAR COMPLEMENTARY PATCH ANTENNA AND ASSOCIATED METHODS

RELATED APPLICATIONS

This application claims priority to U.S. Provisional Patent Application No. 62/754,211, titled "Nonplanar Patch Antenna RF Tag and Associated Methods," filed Nov. 1, 2018, the entirety of which is incorporated herein by reference.

BACKGROUND

Wireless tracking tags, such as those based on ultra-wideband (UWB) radio technology, may be used to track athletes participating in a sporting event in a venue (e.g., a stadium). Tracking tags may similarly be used to track referees, sports equipment (e.g., a football), and other objects used for the sporting event. Each wireless tracking tag periodically transmits a wireless signal that is received by a plurality of receivers located around the venue. Based on the various times at which the wireless signal is received by the plurality of receivers, the position coordinates of the corresponding wireless tracking tag can then be determined via multilateration (e.g., time difference of arrival).

SUMMARY OF THE EMBODIMENTS

A minimum size and weight of a wireless tracking tag are determined by transmission requirements for its intended use. For example, for wireless tracking tags used to track athletes participating in a sporting event on a playing field, receivers must be placed around the playing field such that they do not interfere with the athletes. Locations of the receivers establish a maximum distance between any wireless tracking tag on the playing field and any of the receivers. This maximum distance, in turn, determines a minimum power with which each tracking tag must periodically transmit its wireless signal, and thus a size of a battery that powers each wireless tracking tag.

Some wireless tracking tags use an antenna with a three-dimensional (3D) geometry whose size and structure are obtrusive when configured with athletes and athletic equipment. To protect the antenna, the wireless tracking tags are made mechanically rigid, typically with a hard enclosure. However, this rigidity also makes the enclosure fragile when exposed to bending forces, resulting in breaking rather than flexing.

Some wireless tracking tags use a planar microwave patch antenna that produces a radiation pattern biased unidirectionally toward a normal axis of the tracking tag. Although the patch antenna is a two-dimensional structure, the radiation pattern is not ideal when the tracking tag is oriented with its normal axis pointing away from the receivers (e.g., upward when the receivers are located horizontally around the playing field). In this case, most of the power emitted by the tracking tag is lost, and the tracking tag must transmit at a higher power to ensure that its wireless signal is properly received (i.e., with sufficient signal-to-noise ratio). Higher-power transmissions drain the tracking tag's battery, either limiting its operational lifetime, or requiring a larger battery that makes the tracking tag more obtrusive and prone to damage.

Some wireless tracking tags use a "balanced" or "complementary" architecture in which a pair of antenna elements are differentially driven. Advantageously, this architecture eliminates the need for a bulky "balun" (balanced-to-unbalanced converter) that is required when driving a "single-ended" or "unbalanced" antenna. The balun introduces insertion loss that wastes power, thereby reducing transceiver performance and operational range.

The present embodiments overcome the above problems with a nonplanar complementary patch antenna that includes an antenna ground plane, a first antenna patch that lies in a first plane forming a first angle with the antenna ground plane, and a second antenna patch that lies in a second plane forming a second angle with the antenna ground plane. Compared to prior-art complementary patch antennas in which the antenna patches are coplanar (i.e., each of the first and second angles is 0°), the radiation pattern produced by the nonplanar complementary patch antenna is advantageously biased away from the normal axis of the tracking tag, and therefore requires less power to communicate with receivers when the tracking tag is oriented with its normal axis pointing away from the receivers.

One aspect of the present embodiments includes the realization that there is a tradeoff between a volume enclosed by the nonplanar complementary patch antenna, and the efficiency with which it wirelessly communicates with the receivers. Specifically, as the first and second angles are increased from 0°, the radiation pattern becomes increasing biased away from the normal direction, advantageously improving the efficiency and operability. At the same time, a height of the nonplanar complementary patch antenna increases, thereby increasing its volume. To prevent a nonplanar tracking tag that houses the nonplanar complementary patch antenna from becoming too bulky, it is advantageous to keep the volume (i.e., the height) of the nonplanar complementary patch antenna small. There is a range of the first and second angles within which the efficiency is improved, yet the corresponding increase in volume is negligible. That is, for non-zero first and second angles, the nonplanar complementary patch antenna may still be sufficiently "flat" that the nonplanar tracking tag can be made robust and unobtrusive.

In one embodiment, a nonplanar complementary patch antenna includes an antenna ground plane, a first antenna patch in a first plane forming a first angle with the antenna ground plane, and a second antenna patch in a second plane forming a second angle with the antenna ground plane.

In another embodiment, a nonplanar complementary patch antenna includes a flexible substrate formed with first and second antenna patches and corresponding first and second balanced feed lines. The flexible substrate is configured for forming around a dielectric material having a geometry to position the first and second antenna patches in first and second planes, respectively, that form first and second angles, respectively, with an antenna ground plane.

In another embodiment, a nonplanar tracking tag includes a flexible circuit having a first antenna patch formed at a first end of the flexible circuit, a second antenna patch formed at a second end, opposite the first end, of the flexible circuit, and a transceiver circuit electrically coupled to the first and second antenna patches. The nonplanar tracking tag also includes a battery and a dielectric material having a shape and size to position the first and second antenna patches, when the flexible circuit is wrapped around the dielectric material, in first and second planes, respectively, that form first and second angles, respectively, with an antenna ground plane.

DETAILED DESCRIPTION OF THE EMBODIMENTS

Figure 1:
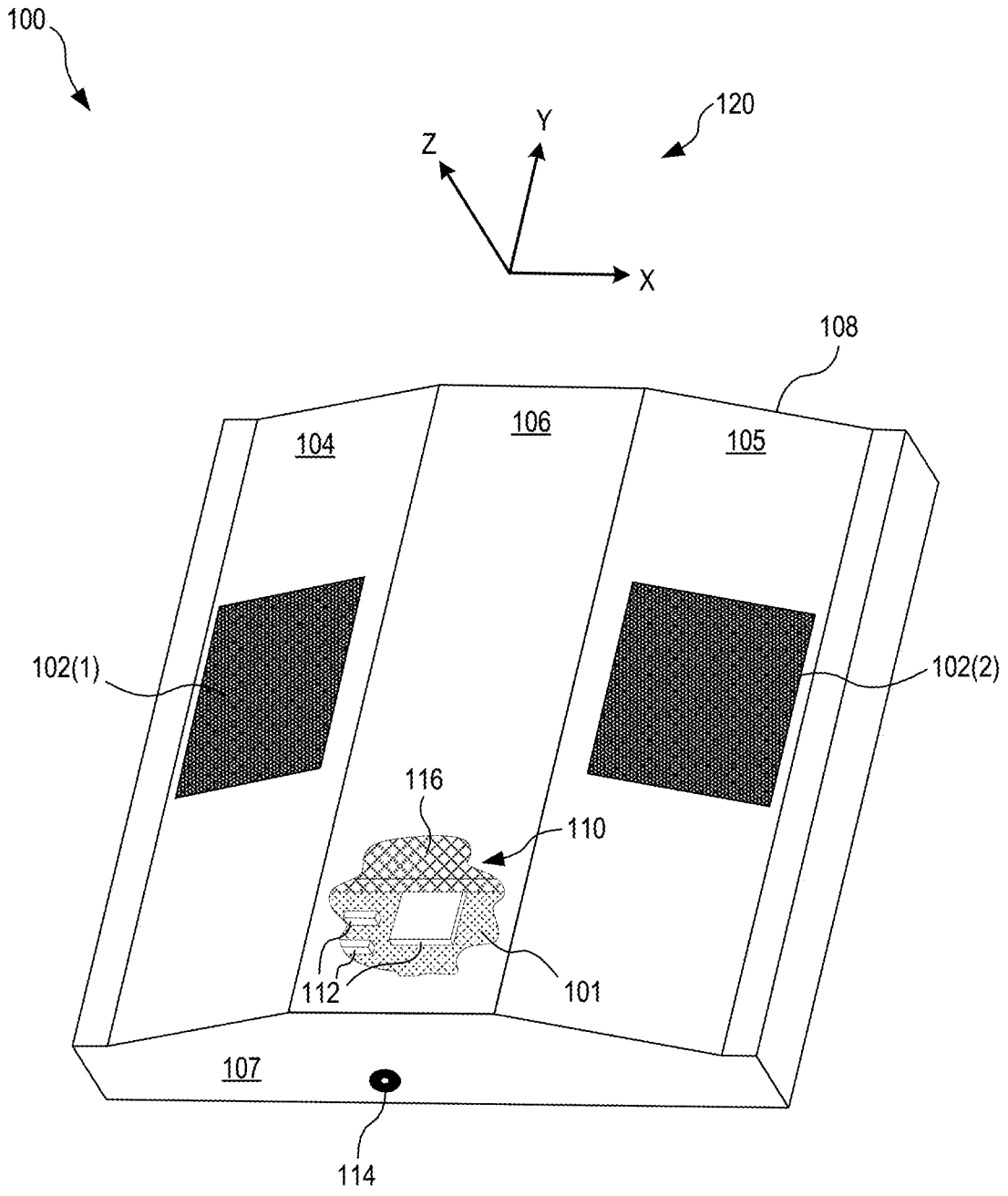
FIG. 1 is a perspective view of a nonplanar tracking tag with a nonplanar complementary patch antenna, in embodiments.

FIG. 1 is a perspective view of a nonplanar tracking tag 100 with a nonplanar complementary patch antenna. Nonplanar tracking tag 100 includes two antenna patches 102(1), 102(2) located on first and second patch panels 104 and 105, respectively. A base 101 extends in the x-y plane (see right-handed Cartesian coordinate axes 120), and is located at the bottom of wireless tracking tag 100 in the z direction (as shown in a cut-away portion 110). First and second patch panels 104 and 105 are positioned above base 101 in the z direction, and are angled so that first and second patch panels 104 and 105 are not parallel to base 101. Patch panels 104, 105 each join opposite sides of a top panel 106 that may be parallel to base 101. Nonplanar tracking tag 100 also has first and second end panels 107 and 108 that are parallel to the x-z plane and connect with base 101, patch panels 104 and 105, and top panel 106.

Figure 2:
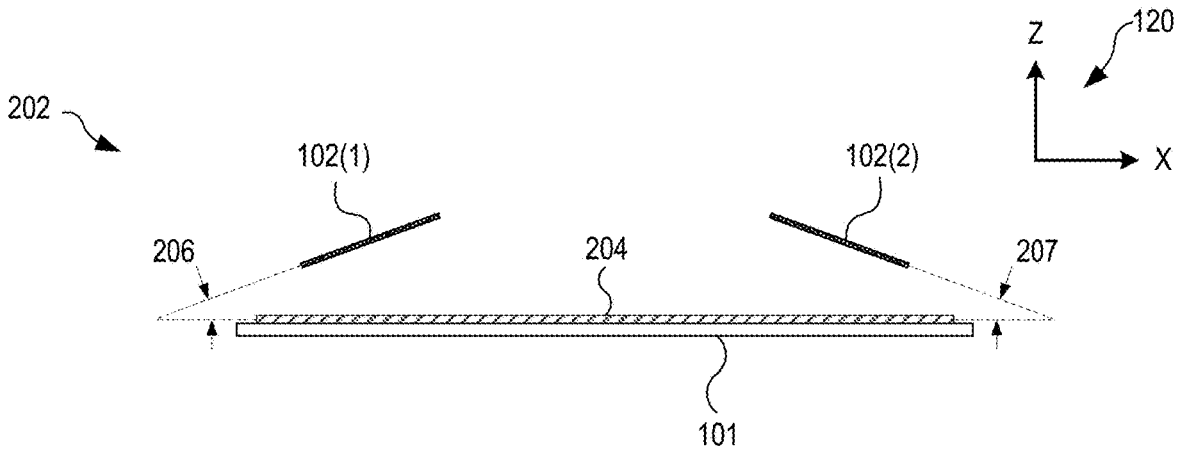
FIGS. 2 and 3 are side and plan views, respectively, of the nonplanar complementary patch antenna included in the nonplanar tracking tag of FIG. 1, in embodiments.
Figure 3:
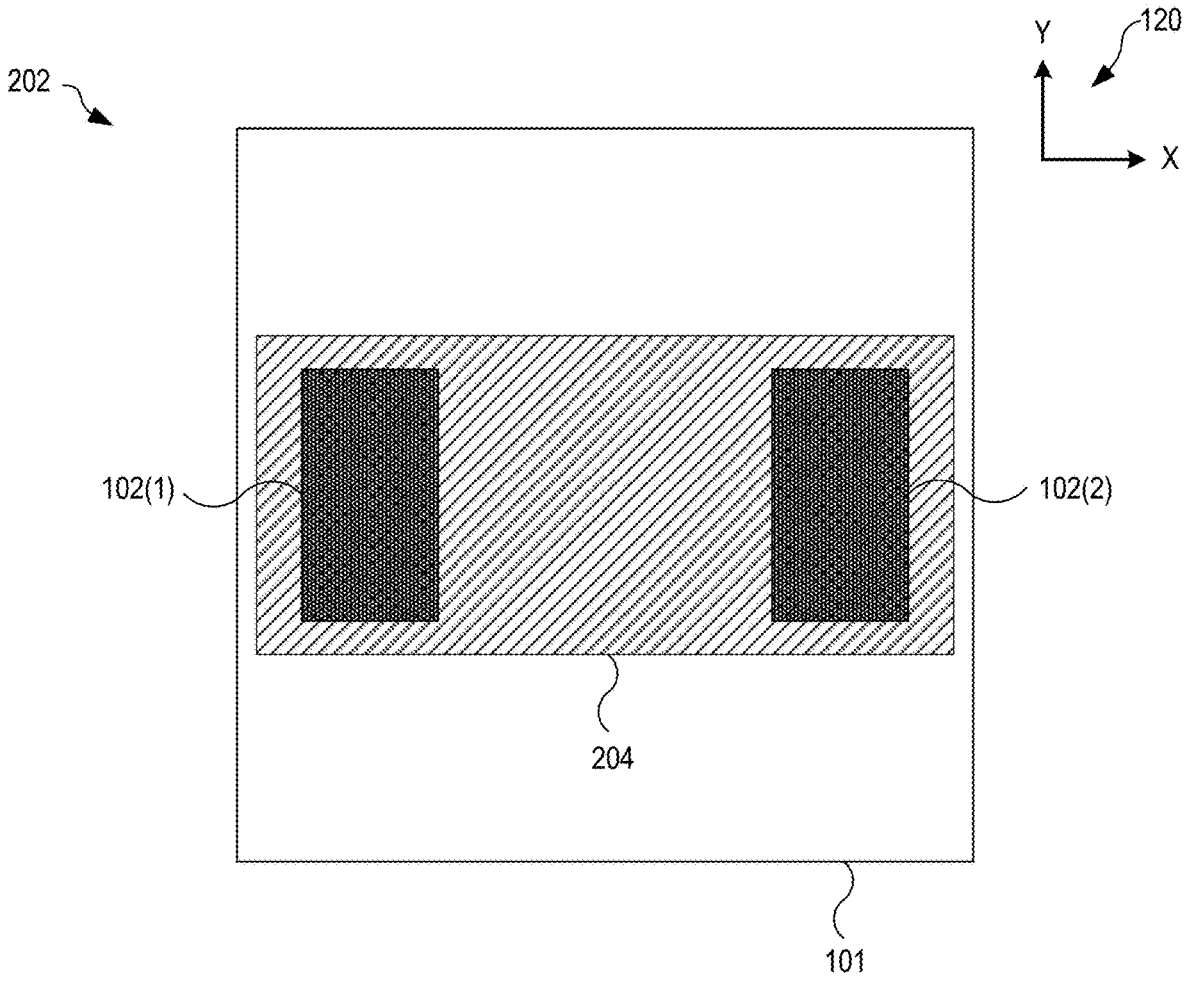

Antenna patches 102(1), 102(2) and an antenna ground plane cooperate to form the nonplanar complementary patch antenna (see complementary patch antenna 202 in FIGS. 2 and 3). Antenna patches 102(1), 102(2) are driven by electrical components 112 located inside nonplanar tracking tag 100 and above base 101 (as shown in cut-away portion 110 of FIG. 1). Electrical components 112 receive power from a rechargeable battery 116 that may be charged via an external power connector 114.

Base 101, patch panels 104 and 105, end panels 107 and 108, and top panel 106 may be formed from flexible materials (e.g., a flexible circuit board) and rechargeable battery 116 may be flexible such that nonplanar tracking tag 100 is also flexible. Accordingly, nonplanar tracking tag 100 is less fragile than rigid wireless tracking tags since it accommodates the inevitable bending forces that occur during use by flexing, rather than breaking. Furthermore, size and weight of nonplanar tracking tag 100 is reduced by (1) using a rechargeable battery instead of a larger, heavier, single-use battery, and (2) using low-profile planar antenna patches 102 that are easier to protect as compared to larger 3D antenna structures. Nonplanar tracking tag 100 may also be sealed to prevent the ingress of moisture, allowing nonplanar tracking tag 100 to operate in wet or dirty conditions as well as being washable.

The advantages of nonplanar tracking 100 of FIG. 1 make it ideal for tracking an individual using a UWB real-time location system. Nonplanar tracking tag 100 may be placed unobtrusively on or in athletic equipment and clothing. To facilitate this placement, nonplanar tracking tag 100 may include provision for attachment, such as areas for sewing, loops, button holes, and the like, for inclusion into the pockets of, and/or sewn into, clothing, uniform fabric, and other attire of an individual. An outside surface of base 101 may have an adhesive coating for adhering nonplanar tracking tag 100 to a surface (e.g., sports equipment, helmet, clothing, skin of the athlete). The adhesive may be protected by a removable layer that allows nonplanar tracking tag 100 to be applied using a technique similar to applying an adhesive bandage or small medical dressing for bodily injuries. In another example, nonplanar tracking tag 100 may be configured for attaching to a bicycle to allow a real-time location tracking system to track the movement of the bicycle. In another example, nonplanar tracking tag 100 is configured for attaching to a lanyard and worn like a pendant.

FIGS. 2 and 3 are side and plan views, respectively, of nonplanar complementary patch antenna 202 included in nonplanar tracking tag 100 of FIG. 1. Nonplanar complementary patch antenna 202 includes antenna patches 102(1), 102(2), feed lines (see balanced feed lines 705 in FIG. 7), and an antenna ground plane 204 that is parallel to base 101 and positioned beneath antenna patches 102(1), 102(2) in the z direction. Antenna patches 102(1) and 102(2) lie in first and second planes that form first and second patch angles 206, 207 with the mathematical plane in which antenna ground plane 204 lies. The straight line forming an intersection of the first and second planes may be parallel to antenna ground plane 204 and on the same side of antenna ground plane 204 as antenna patches 102(1), 102(2).

Advantageously, patch angles 206 and 207 may be selected to create a radiation pattern (e.g., see radiation pattern 400 of FIG. 4) with a higher directivity in certain directions and a reduced directivity in other directions. For example, the radiation pattern of nonplanar complementary patch antenna 202 may be configured with greatest directivity in directions where tracking receivers are located relative to the positioning of nonplanar tracking tag 100, thereby improving the range and/or reducing the power consumption of nonplanar tracking tag 100.

Figure 4:
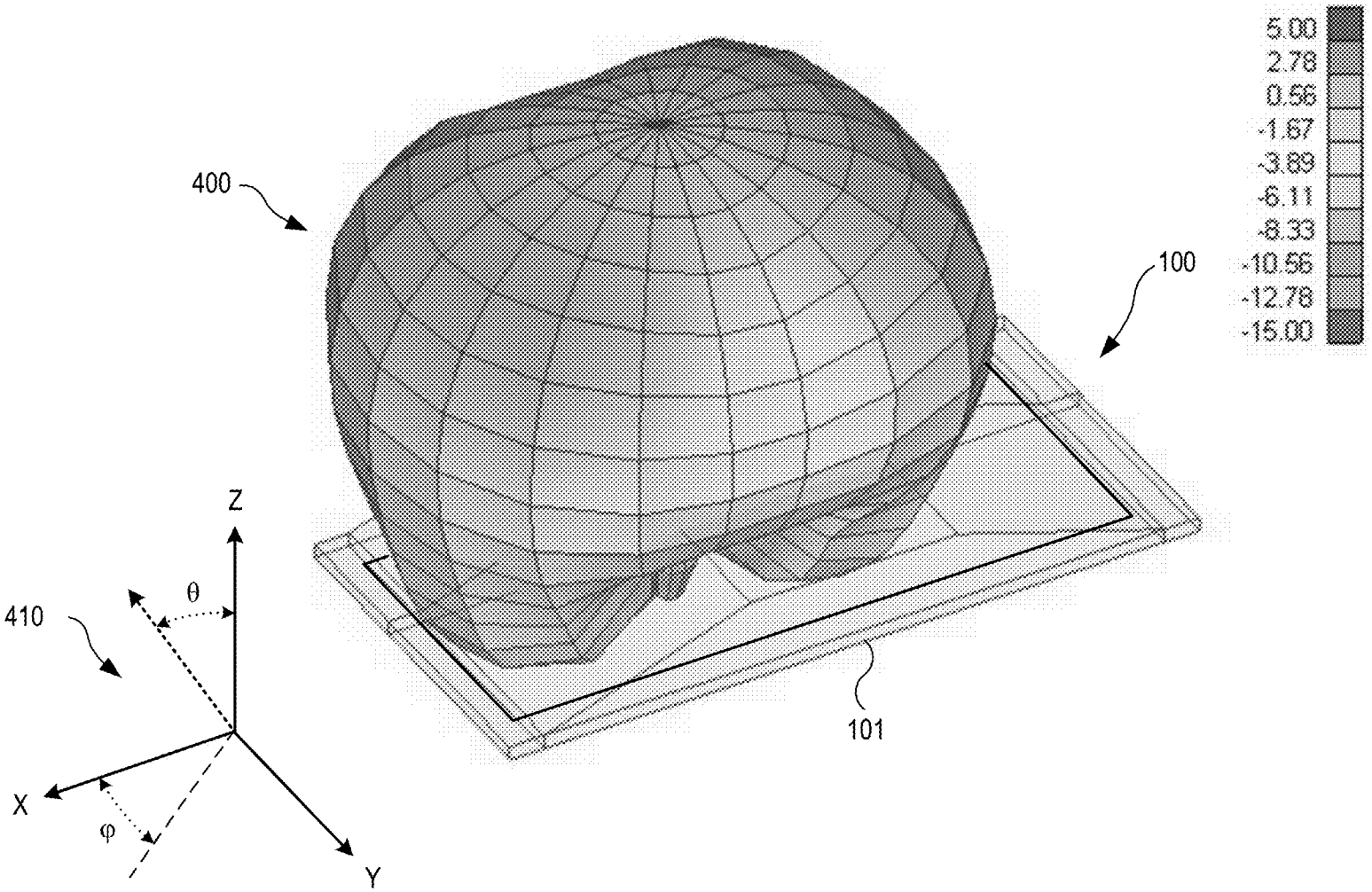
FIG. 4 shows a radiation pattern of the nonplanar complementary patch antenna of FIG. 2.
Figure 5:
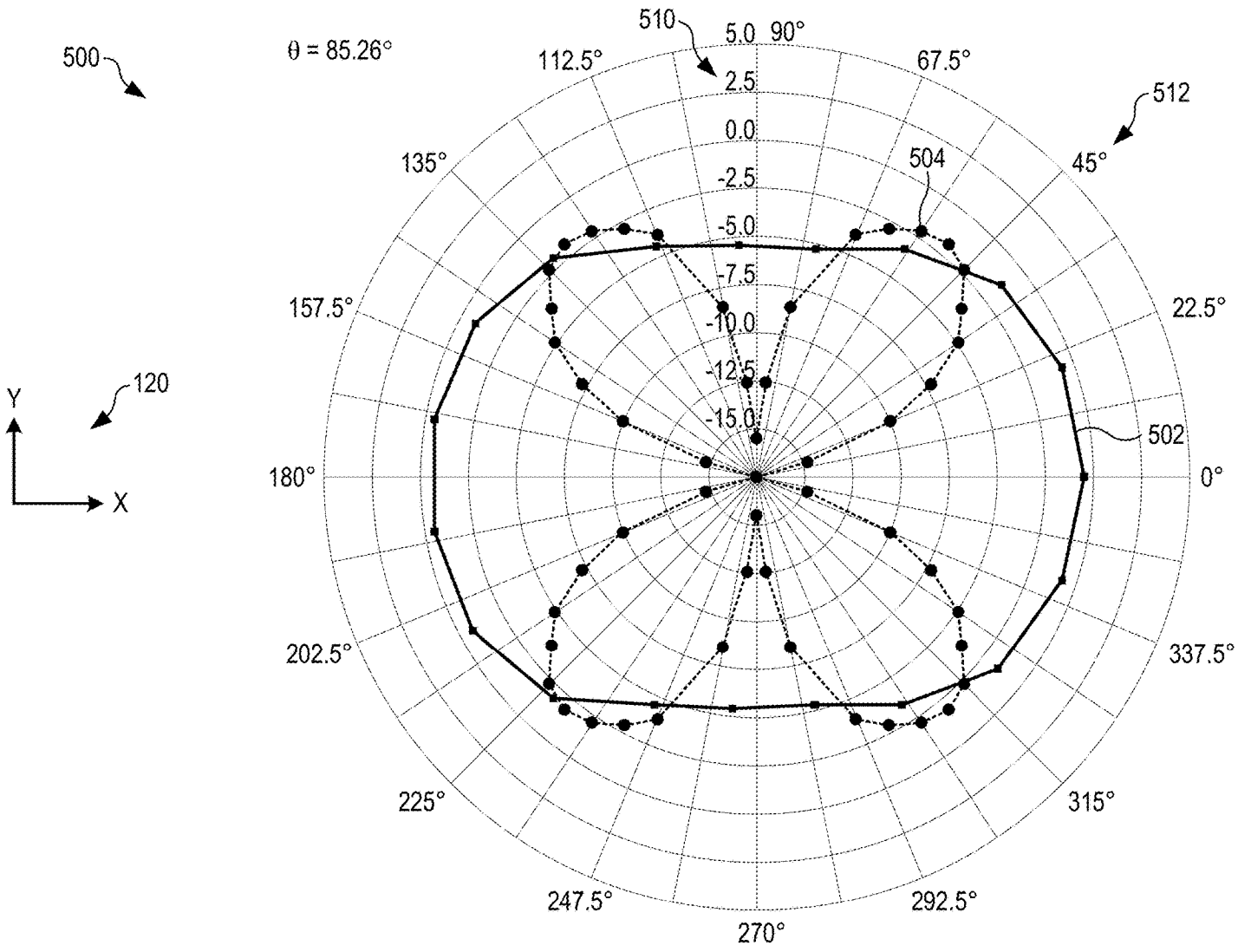
FIGS. 5 and 6 are polar plots comparing the radiation pattern of FIG. 4 with a far-field radiation pattern of a square planar patch antenna, at two polar angles.
Figure 6:
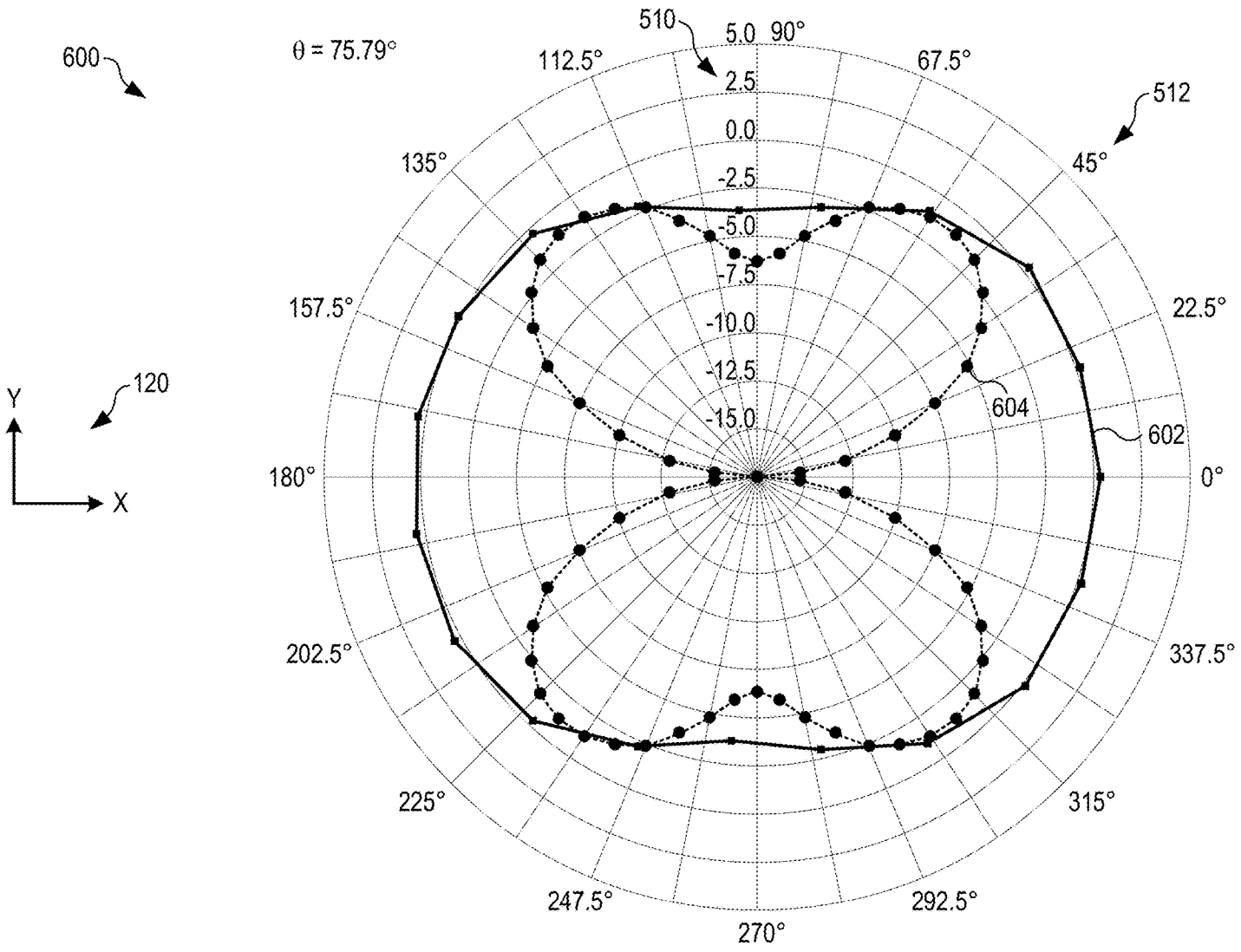

FIG. 4 shows a radiation pattern 400 at 6.5 GHz of nonplanar complementary patch antenna 202 of nonplanar tracking tag 100. FIGS. 5 and 6 are polar plots 500, 600 comparing radiation pattern 400 with a far-field radiation pattern of a square planar patch antenna, at polar angles of $\theta=85.26°$ and $\theta=75.79°$, respectively. FIGS. 4-6 illustrate how patch angles 206 and 207 may be selected to generate a radiation pattern advantageous for certain wireless tracking applications. FIGS. 4-6 are best viewed together with the following description.

In FIG. 4, the orientation of radiation pattern 400 is shown relative to spherical coordinate axes 410. The origin is at the center of nonplanar tracking tag 100 in the x and y directions, and at the bottom of base 101 in the z direction. Azimuthal angle $\varphi$ is defined in the x-y plane relative to the positive x axis, and polar angle $\theta$ is defined relative to the positive z axis.

In FIGS. 5 and 6, polar plots 500 and 600 show antenna directivities 510, in decibels relative to a theoretical isotropic point source, versus azimuthal angles 512, in degrees. Data points 502 and 602, shown in FIGS. 5 and 6 as squares connected by a solid line, correspond to a far-field of radiation pattern 400, as numerically simulated on a computer. Data points 504 and 604, shown in FIGS. 5 and 6 as circles connected by a dashed line, correspond to the square planar patch antenna, wherein a width and length of the square patch each equal one-half of the radiating wavelength, and the square patch lies in the x-y plane. Points 504 and 604 are computed from analytic equations that model the square planar patch antenna as two radiating slots coinciding with two opposing edges of the square patch (the other two opposing edges of the square patch are non-radiating).

Patch angles 206 and 207 are configured such that as polar angle θ approaches 90°, nonplanar complementary patch antenna 202 has an increasingly higher directivity along the x-axis (i.e., at φ=0° and 180°) and y-axis (i.e., at φ=90° and 270°) compared to the square planar patch antenna. As shown in FIG. 5 for θ=85.26°, nonplanar complementary patch antenna 202 has 15 dB higher directivity along the x-axis, and 10 dB higher directivity along the y-axis, compared to the square planar patch antenna. As shown in FIG. 6 for θ=75.79°, nonplanar complementary patch antenna 202 has 15 dB higher directivity along the x-axis, and 3 dB higher directivity along the y-axis, compared to the square planar patch antenna.

Thus, nonplanar tracking tag 100 advantageously projects more radiant intensity towards locations where it may be preferable to place receivers communicating with nonplanar tracking tag 100. As discussed in more detail below, one example where it may be beneficial to increase power along the x-axis is tracking the locations of players on a rectangular sports field, such as an American football field, wherein the tracking receivers may be placed behind the end zones of the football field (see FIGS. 15-17). By directing more power towards along directions coinciding with receivers, and less power upward to the sky, nonplanar tracking tag 100 advantageously uses less power than a planar patch antenna of the same orientation, and thus may operate over longer distances to the receivers. Alternatively, nonplanar tracking tag 100 may consume less electrical power, thereby allowing for a smaller battery 116 and/or longer operating charge lifetime of battery 116, as compared to the planar patch antenna of the same orientation.

In one embodiment, size, geometry, location, and orientation, of antenna patches 102(1) and 102(2) relative to antenna ground plane 204 are selected to transmit a wireless UWB signal with a desired radiation pattern (e.g., radiation pattern 400 of FIG. 4) for use in a real-time location system. In the example of FIG. 1, antenna patches 102(1), 102(2) are rectangular with a patch length (in the y direction) longer than a patch width (in the x-z plane of patch panels 104, 105), and where the patch width is shorter than the widths of patch panels 104, 105. However, antenna patches 102(1) and 102(2) may have other shapes and sizes without departing from the embodiments herein, such as one or more of regular polygonal (e.g., square), irregular polygonal (e.g., rectangular), circular, and elliptical. In certain embodiments, antenna patches 102(1), 102(2) have a patch width similar to the widths of patch panels 104, 105. Also, as shown in the example of FIG. 1, antenna patches 102(1), 102(2) may be centered on first and second patch panels 104 and 105, respectively, in the y direction; however, in other embodiments, antenna patches 102(1), 102(2) are not centered. In certain embodiments, antenna patches 102(1), 102(2) are offset from each other in the y direction.

In one embodiment, nonplanar tracking tag 100 operates at a frequency between 3.1 and 10.6 GHz, for use with a UWB radio system or a high-data-rate personal area network. In one example, nonplanar tracking tag 100 operates at a frequency of 6.5 GHz. In another embodiment, nonplanar tracking tag 100 operates at a frequency of 2.4 GHz and/or 5.8 GHz, for use with a Wi-Fi wireless local area network. In these embodiments, a patch length and a patch width of antenna patches 102(1), 102(2) may be chosen according to the frequency and/or a relative dielectric constant of a dielectric material disposed near antenna patches 102(1), 102(2) (e.g., see shaped dielectric material 1202 of FIGS. 12 and 13). In one example, antenna patches 102(1), 102(2) are rectangular with the patch length being 19 mm and the patch width being 15 mm.

A size, geometry, and location of antenna ground plane 204 may be selected to achieve a radiation pattern (e.g., radiation pattern 400 of FIG. 4) from nonplanar complementary patch antenna 202 suitable for use in a real-time location system. For example, antenna ground plane 204 may be selected to generate fringe electric fields between edges of antenna patches 102(1), 102(2) and antenna ground plane 204, and to ensure a high front-to-back ratio (e.g., the ratio of power gain between a front (z>0) and a rear (z<0)), as shown in radiation pattern 400 of FIG. 4. In the examples of FIGS. 2 and 3, antenna ground plane 204 is rectangular with edges that extend past the edges of antenna patches 102(1), 102(2). In some embodiments, antenna ground plane 204 is formed as two non-overlapping rectangular segments, each segment having edges that extend past the edges of one of antenna patches 102(1), 102(2).

In the examples of FIGS. 2 and 3, antenna ground plane 204 is formed on a top (in the z direction) surface of base 101. Alternatively, antenna ground plane 204 may be located within or on a bottom surface of base 101, or formed from a metal housing of rechargeable battery 116.

Figure 7:
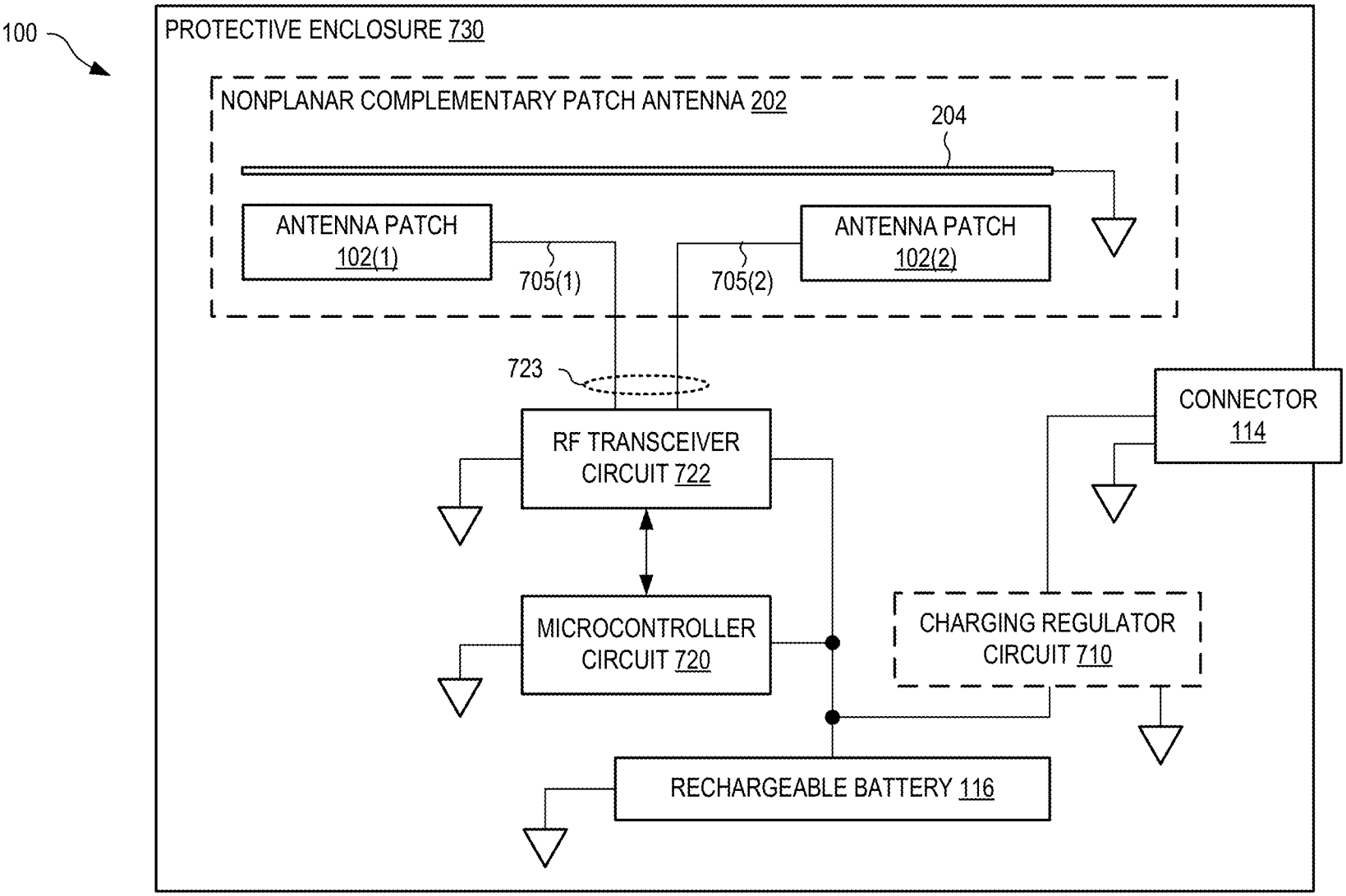
FIG. 7 is a schematic illustrating example circuitry and functionality of the nonplanar tracking tag of FIG. 1, in embodiments.

FIG. 7 is a schematic illustrating example circuitry and functionality of nonplanar tracking tag 100 of FIG. 1. Nonplanar complementary patch antenna 202 includes antenna patches 102(1) and 102(2), antenna ground plane 204, and balanced feed lines 705(1) and 705(2) that are driven by a differential output 723 of an RF transceiver circuit 722. Microcontroller circuit 720 controls RF transceiver circuit 722 to transmit data-encoded signals via nonplanar complementary patch antenna 202. For example, microcontroller circuit 720 may encode a signal with data identifying (e.g., a serial number or an identification number) nonplanar tracking tag 100 (or a user thereof) to a receiver of the transmitted signal. Microcontroller circuit 720 may include memory for storing the identifying data. In certain embodiments, RF transceiver circuit 722 is implemented with only transmit functionality.

Nonplanar complementary patch antenna 202 may also receive wireless signals, wherein differential output 723 of RF transceiver circuit 722 is also a differential input. RF transceiver circuit 722 may decode information from received signals such that microcontroller circuit 720 may respond to, or act according upon, the decoded information. For example, the decoded information may request for nonplanar tracking tag 100 to transmit identifying information.

Advantageously, complementary patch antenna 202 has a balanced input that may connect directly to differential output 723 of RF transceiver circuit 722 and does not require a balun. Accordingly, electrical power loss associated with a balun is not incurred, thereby improving transceiver performance and range.

Microcontroller circuit 720 and RF transceiver circuit 722 are powered from rechargeable battery 116 that may be recharged via external power connector 114 when connected to an external regulated power source. In certain embodiments, nonplanar tracking tag 100 may include a charging regulator circuit 710 to regulate electrical power received from external power connector 114 to charge rechargeable battery 116 when the external power is unregulated. In one embodiment, charging regulator circuit 710 and external power connector 114 are omitted and rechargeable battery 116 is replaced with a one-time use, long-life, flexible battery.

Figure 8:
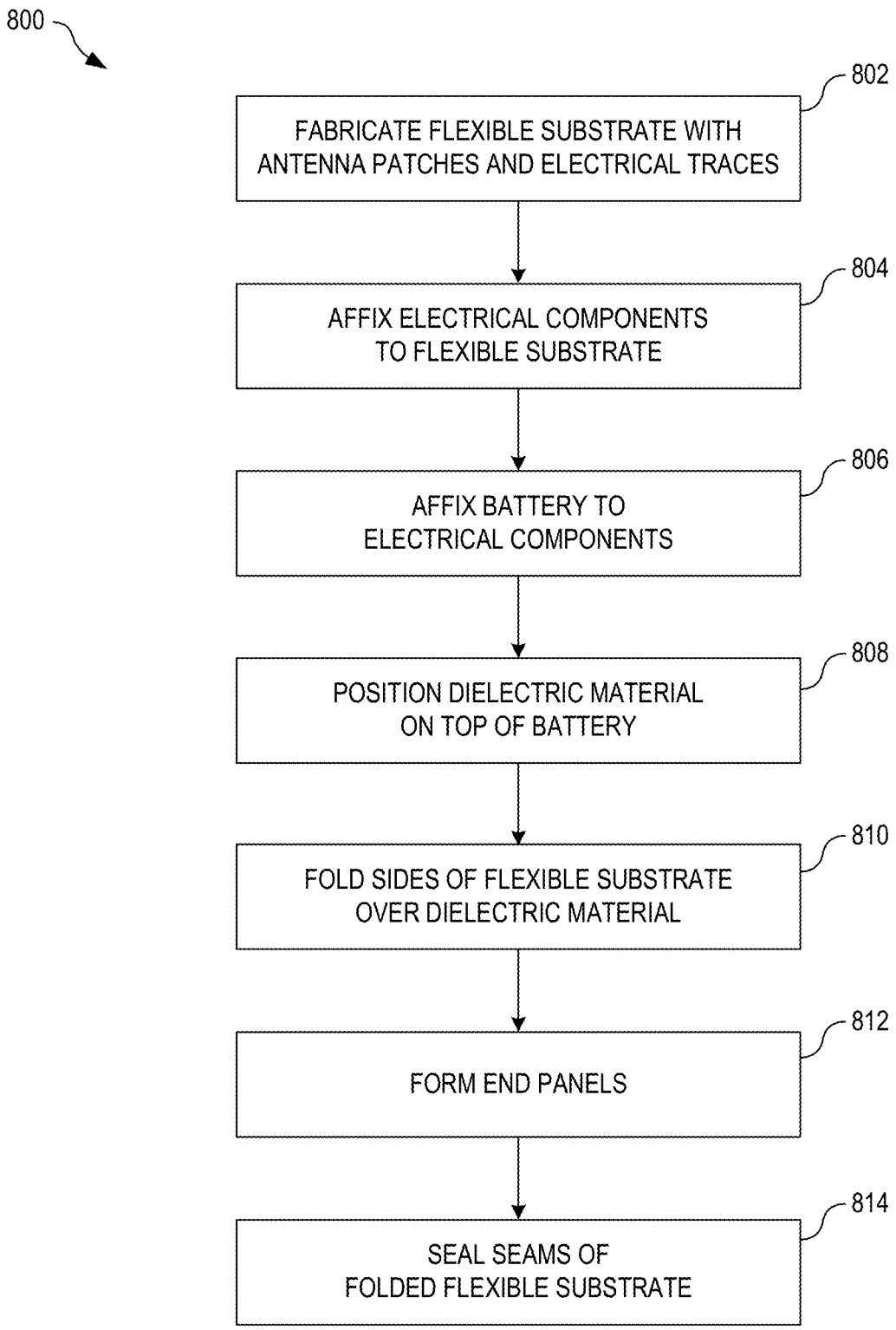
FIG. 8 is a flowchart showing one example method for fabricating the nonplanar tracking tag of FIGS. 1 and 7, in embodiments.

FIG. 8 is a flowchart showing one example method 800 for fabricating nonplanar tracking tag 100 of FIGS. 1 and 7. FIGS. 9-14 show various stages of fabricating nonplanar tracking tag 100 using method 800 of FIG. 8. FIGS. 8-14 are best viewed together with the following description.

Figure 9:
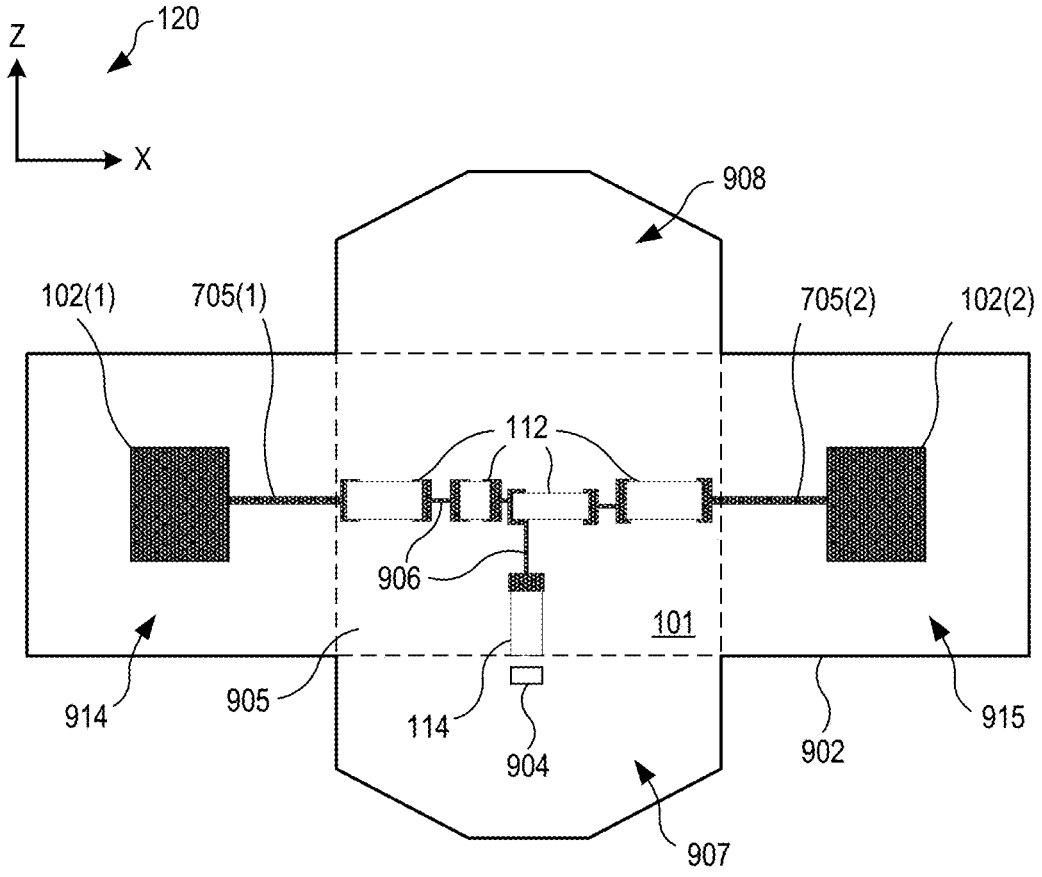
FIG. 9 is a plan view of a flexible circuit used to fabricate the nonplanar tracking tag of FIGS. 1 and 7, according to an embodiment.
Figure 10:
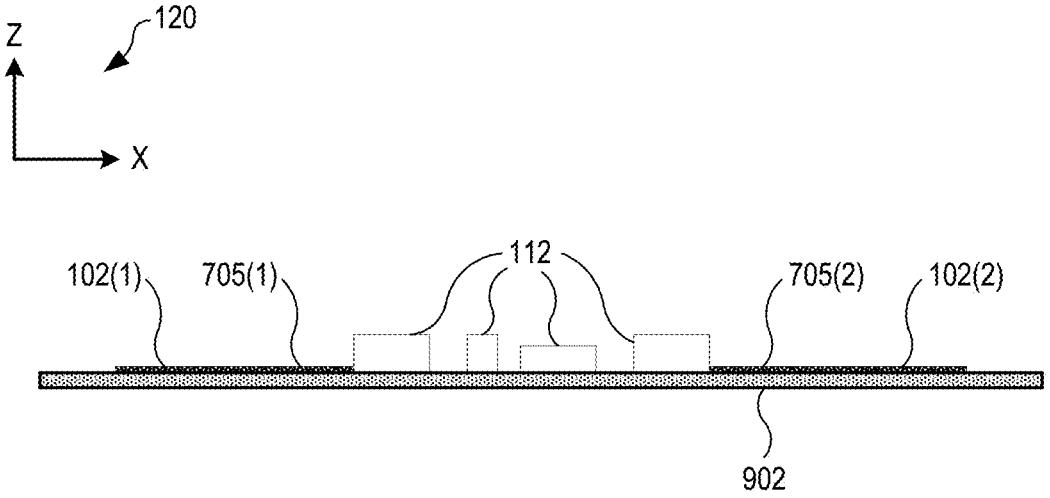
FIGS. 10-14 are side views of the flexible circuit of FIG. 9 as manipulated during the fabrication method of FIG. 8.

In a block 802 of method 800, flexible substrate 902 is fabricated with antenna patches and electrical traces. FIGS. 9 and 10 are a plan view and side view, respectively, of a flexible substrate 902 formed with one or more layers that include electrically conductive segments (e.g., metal traces, pads, vias) that form antenna patches 102(1), 102(2), antenna feed lines 705(1), 705(2), and antenna ground plane 204. In one example of block 802, antenna patches 102(1), 102(2) and antenna feed lines 705(1), 705(2) are formed on a top surface 905 of flexible substrate 902, as shown in the example of FIG. 9.

Flexible substrate 902 may be cross-shaped, with first and second side flaps 914, 915, and first and second end flaps 907, 908, as shown in FIG. 9. Flexible substrate 902 may also form (e.g., by cutting, punching, milling, or drilling) an opening 904 for accepting external power connector 114. Alternatively, external power connector 114 may be formed as a pair of electrically conductive pads on a bottom surface of flexible substrate 902.

In a block 804 of method 800, electrical components are affixed to the flexible substrate. In one example of block 804, electrical components 112 are soldered and/or adhered using electrically conductive epoxy to electrically conductive traces 906 on top surface 905 of flexible substrate 902, as shown in FIGS. 9 and 10. In certain embodiments of block 804, antenna patches 102(1), 102(2) are not formed on or within flexible substrate 902 in block 802, and each of antenna patches 102(1) and 102(2) is formed of a metal plate (e.g., copper) that is connected (e.g., soldered and/or adhered) to pads formed, in block 802, on top surface 905 of flexible substrate 902.

Figure 11:
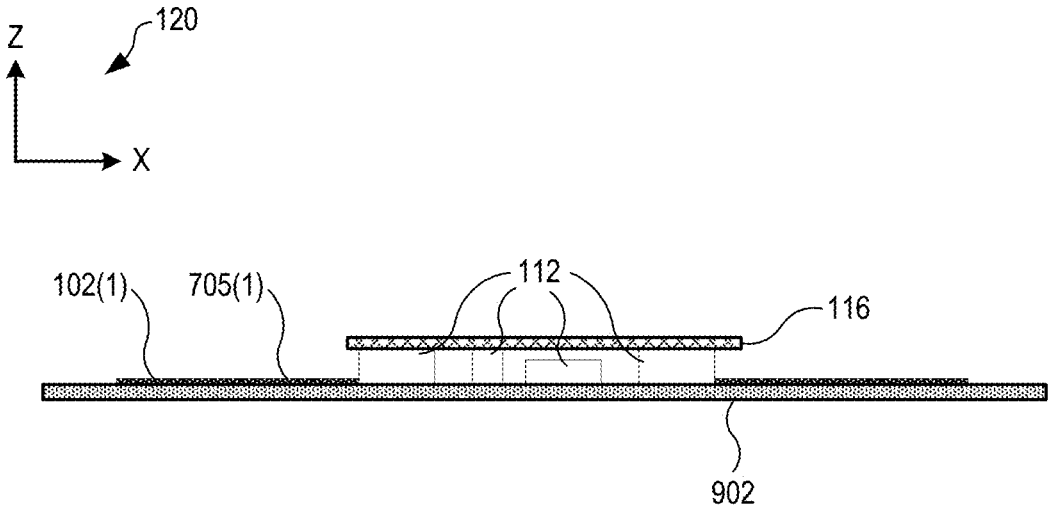

In a block 806 of method 800, a battery is electrically affixed to the electrical components. In one example of block 806, rechargeable battery 116 is adhered to electrical components 112, as shown in FIG. 11. Rechargeable battery 116 may be flat and flexible. In one embodiment, rechargeable battery 116 is a rechargeable lithium polymer battery from BrightVolt, Inc. In certain embodiments, rechargeable battery 116 is encased in metal that serves as ground for electrical components 112 and/or as antenna ground plane 204.

Figure 12:
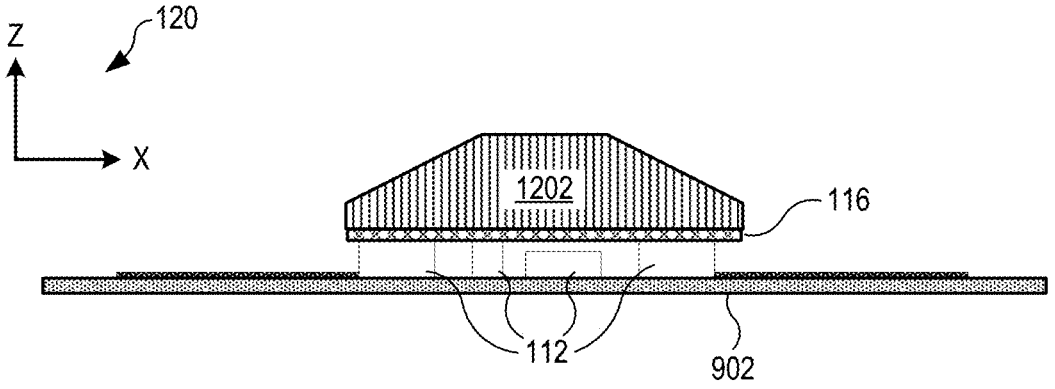

In a block 808 of method 800, a dielectric material is positioned on top of the battery. In one example of block 808, a shaped dielectric material 1202 is placed on a top surface of rechargeable battery 116, as shown in FIG. 12. Dielectric material 1202 may be chosen to modify radiation pattern 400 of nonplanar tracking tag 100 for use in a real-time location system, and may be shaped to provide mechanical support to patch panels 104, 105 and top panel 106.

Figure 13:
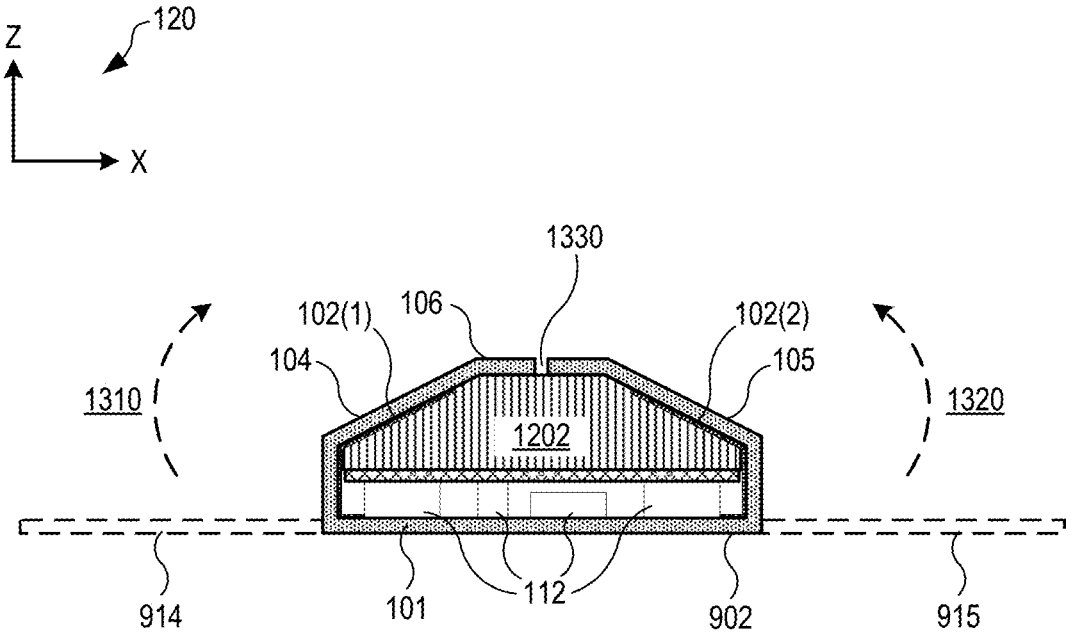

In a block 810 of method 800, sides of the flexible substrate are folded over the dielectric material. In one example of folds 810, first side flap 914 of flexible substrate 902 is folded in a first folding direction 1310 over dielectric material 1202 to form first patch panel 104, and second side flap 915 is folded in a second folding direction 1320 over dielectric material 1202 to form second patch panel 105, as shown in FIG. 13. Side flaps 914, 915 may also form top panel 106 with a top seam 1330. As in the examples of FIGS. 1 and 13, first and second patch panels 104, 105 may have the same width and lie in planes that form the same angle with a plane of base 101, wherein top panel 106 is (a) parallel to base 101, and (b) centered with respect to base 101 in the x direction.

Antenna feed lines 705(1), 705(2) may have a constant characteristic impedance, and may be fabricated as microstrip transmission lines, traditional stripline transmission lines, or co-planar waveguides. When antenna feed lines 705(1), 705(2) are fabricated as microstrip or traditional transmission lines, antenna feed lines 705(1), 705(2) include a transmission ground plane below and/or above a corresponding signal conductor, wherein a dielectric material separates the transmission ground plane from each signal conductor. For example, signal conductors of antenna feed lines 705(1), 705(2) may be formed on top surface 905 of flexible substrate 902, and a transmission ground plane may be placed on a bottom surface of flexible substrate 902, such that flexible substrate 902 forms the dielectric material separating the transmission ground plane from the signal conductors. In one embodiment, antenna feed lines 705(1), 705(2) are fabricated as grounded co-planar waveguides. In another embodiment, antenna feed lines 705(1), 705(2) are fabricated as conventional co-planar waveguides, wherein the transmission ground plane is formed on the same surface of flexible substrate 902 as the signal conductors such that the transmission ground plane lies adjacent to the signal conductors.

As will be appreciated by those trained in the art, in block 810 of method 800, antenna feed lines 705(1), 705(2) may be folded similarly to side flaps 914, 915, affecting the impedance of antenna feed lines 705(1), 705(2). In one embodiment, signal transmission along antenna feed lines 705(1), 705(2) is simulated with a computer (e.g., with three-dimensional finite element analysis) so as to account for the folding, wherein a design of antenna feed lines 705(1), 705(2) is modified to compensate for the effects of bending of antenna feed lines 705(1), 705(2).

Figure 14:
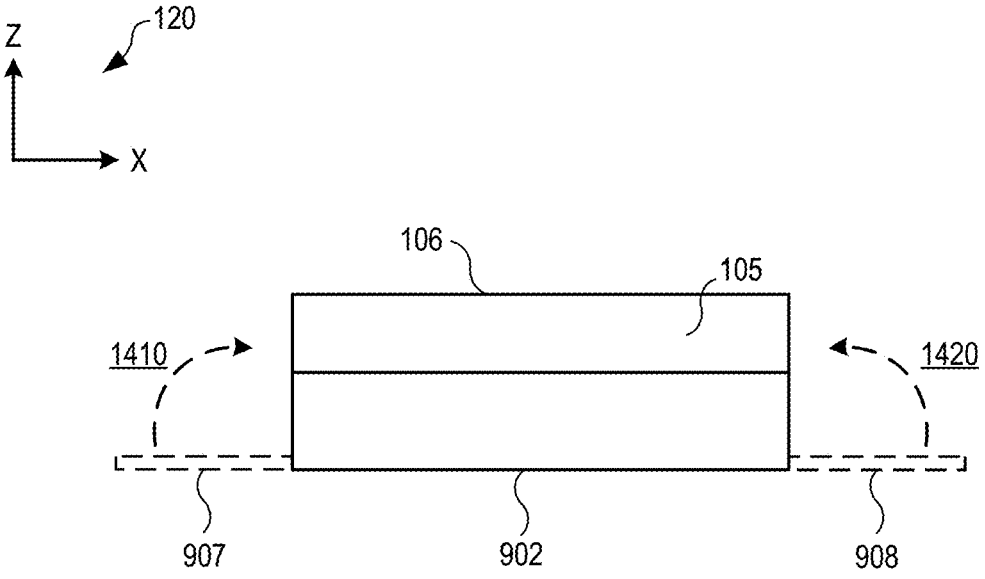

In a block 812 of method 800, the end panels are formed. In one example of block 812, first end flap 907 is folded in a first end folding direction 1410 to form first end panel 107, and second end flap 908 is folded in a second end folding direction 1420 to form second end panel 108, as shown in FIG. 14. After folding, flexible substrate 902 forms a protective enclosure 730 (see FIG. 7) that encases electrical components 112 (including RF transceiver circuit 722, microcontroller circuit 720, and charging regulator circuit 710), rechargeable battery 116, antenna patches 102(1), 102(2), and antenna feed lines 705(1), 705(2).

In another example of block 812, where end flaps 907 and 908 are omitted from flexible substrate 902 in block 802, end panels 107 and 108 are formed from a waterproof sealant. In another example of block 812, end flaps 907 and 908 are formed, in block 802, with side tabs that may be secured to (e.g., adhered to) edges of side flaps 914, 915, after side flaps 914, 915 are wrapped around dielectric material 1202, to improve integrity and/or sealing of nonplanar tracking tag 100. Alternatively, side tabs may be formed on side flaps 914 and 915 such that they may be secured to end flaps 907 and 908.

In the example of FIG. 9, antenna patches 102(1) and 102(2) are formed on top surface 905 such that after substrate 902 is folded in block 810, antenna patches 102(1), 102(2) are positioned on the inner faces of patch panels 104, 105, as shown in FIG. 13. However, antenna patches 102(1), 102(2) may be formed on or within flexible substrate 902 to be within, or on the outer faces of, first and second patch panels 104, 105, without departing from the scope hereof.

In a block 814 of method 800, seams of the folded flexible substrate are sealed, thereby forming protective enclosure 730 (FIG. 7). For example, top seam 1330 may be sealed by covering and/or filling top seam 1330 with tape, epoxy, thermosetting plastics, silicone rubber (e.g., room-temperature-vulcanizing (RTV) silicone), and the like, to aid sealing and make protective enclosure 730 waterproof. Seams produced where each of patch panels 104, 105 meets end panels 107, 108 may be sealed in a similar manner. In one embodiment, top seam 1330 and/or other seams are sealed by dielectric material 1202. In another embodiment, flexible substrate 902 adheres to dielectric material 1202, sealing top seam 1330.

External power connector 114 is configured to allow charging of rechargeable battery 116 without opening protective enclosure 730. For example, external power connector 114 may be a waterproof type electrical connector that is permanently sealed within opening 904, such that nonplanar tracking tag 100 is waterproof irrespective of whether connector 114 is coupled to external power. In another embodiment, external power connector 114 is external to protective enclosure 730, which is sealed around the electrical connections running between external power connector 114 and charging regulator circuit 710 and/or rechargeable battery 116.

When formed as a pair of electrically conductive pads on a bottom surface of flexible substrate 902, external power connector 114 is positioned, after folding of flexible substrate 902, on one of end panels 107, 108 or base 101. Advantageously, electrically conductive pads allow rechargeable battery 116 to be recharged by simply placing nonplanar tracking tag 100 inside of a cradle that connects the pads to the external power source.

In some embodiments, a tag width, tag length, and tag height (in the x, y, and z directions, respectively) of nonplanar tracking tag 100 are selected to accommodate sizes, orientations, and positions of electrical components 112, rechargeable battery 116, and dielectric material 1202. In another embodiment, the tag width and tag length of nonplanar tracking tag 100 are selected according to a length and width of antenna ground plane 204. In another embodiment, the tag width, tag length, and tag height of nonplanar tracking tag 100 are selected such that a size of patch panels 104, 105 accommodates the patch length and patch width of antenna patches 102(1), 102(2). In another embodiment, nonplanar tracking tag 100 has a tag width of 25 mm, a tag length of 50 mm, and a tag height of 6 mm.

Figure 15:
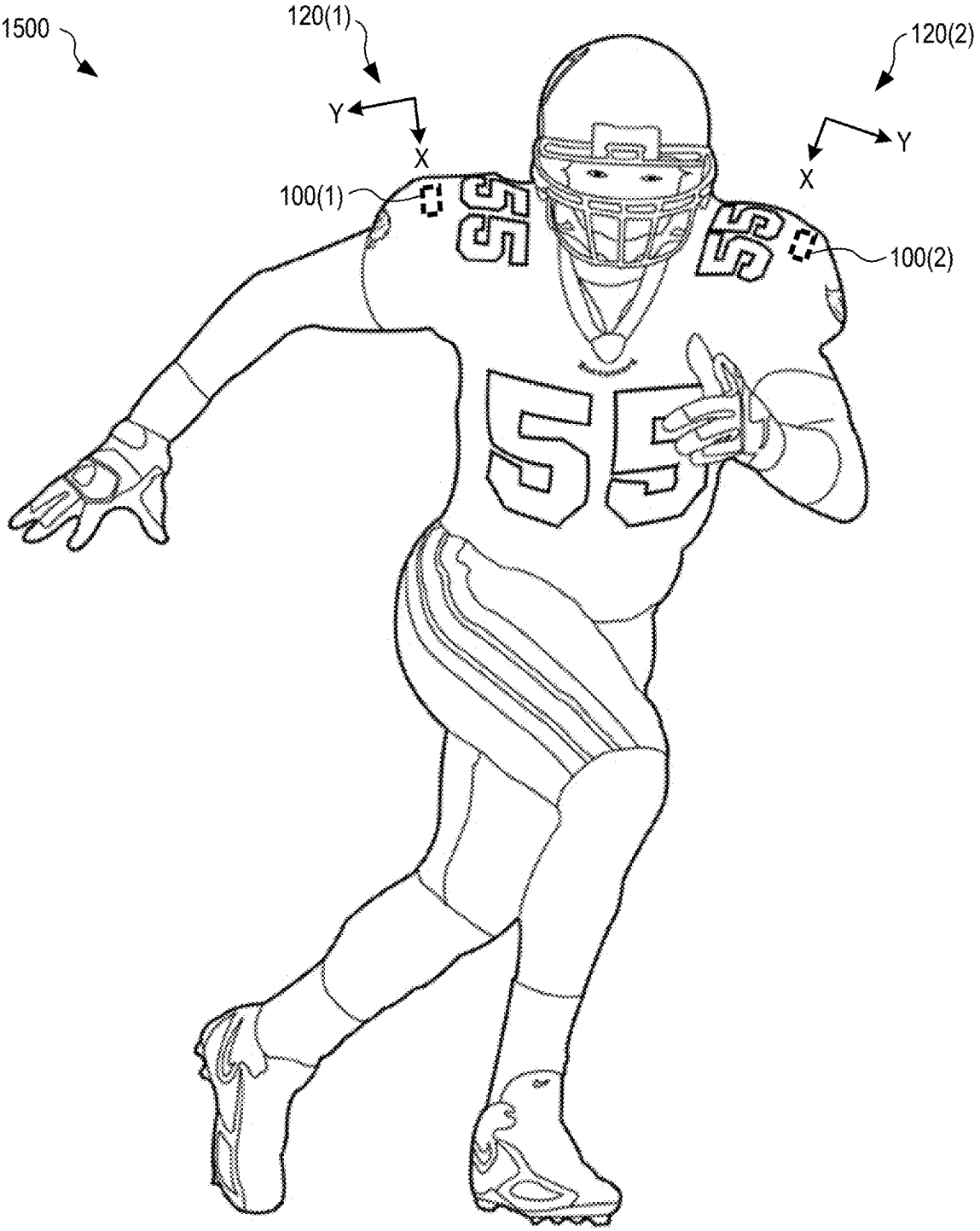
FIG. 15 shows two nonplanar tracking tags of FIGS. 1 and 7 positioned on an American football player.

FIG. 15 shows two nonplanar tracking tags 100(1), 100(2) of FIGS. 1 and 7 positioned on an American football player 1500. Each nonplanar tracking tag 100(1), 100(2) is positioned on a shoulder of player 1500 and oriented (see orientation references 120(1) and 120(2)) such that the highest directivities are in the forward and backward directions (relative to player 1500) when player 1500 stand upright. Thus, less of the transmitted energy is absorbed by the player's body, since less power is transmitted in that direction, as compared to a conventional UWB omnidirectional antenna.

Figure 16:
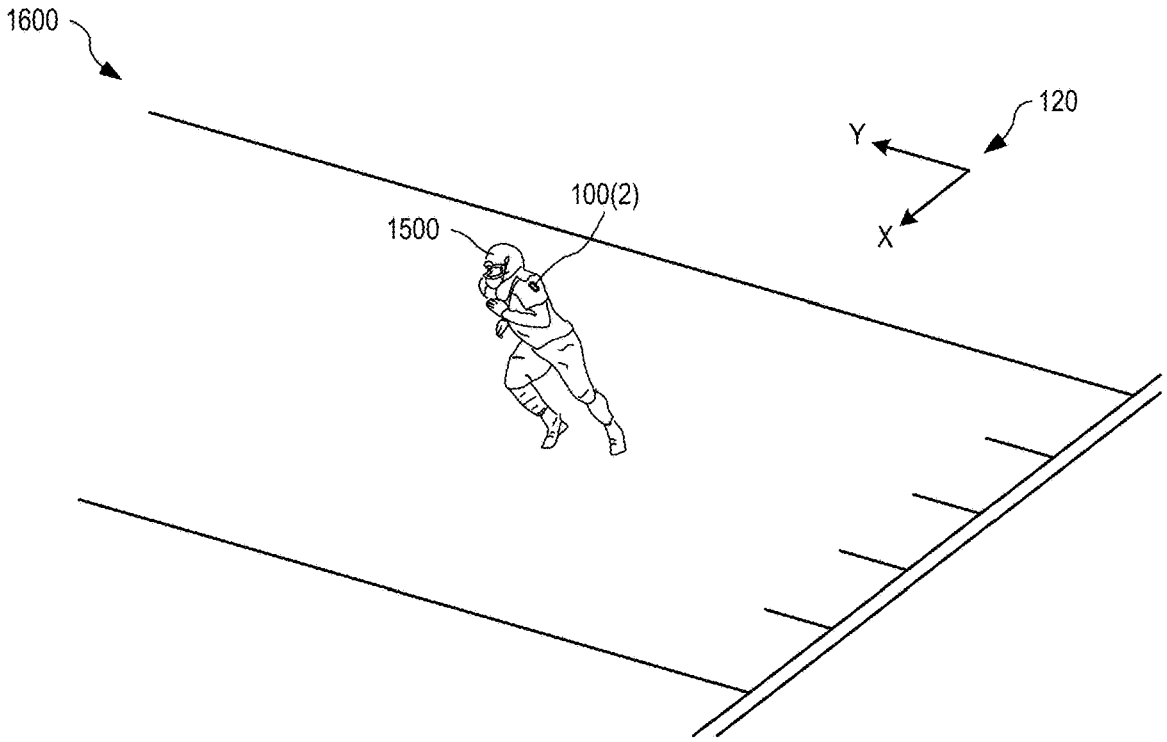
FIGS. 16 and 17 show example propagation of transmissions from nonplanar tracking tags configured with the player of FIG. 15 on an American football field, in an embodiment.
Figure 17:
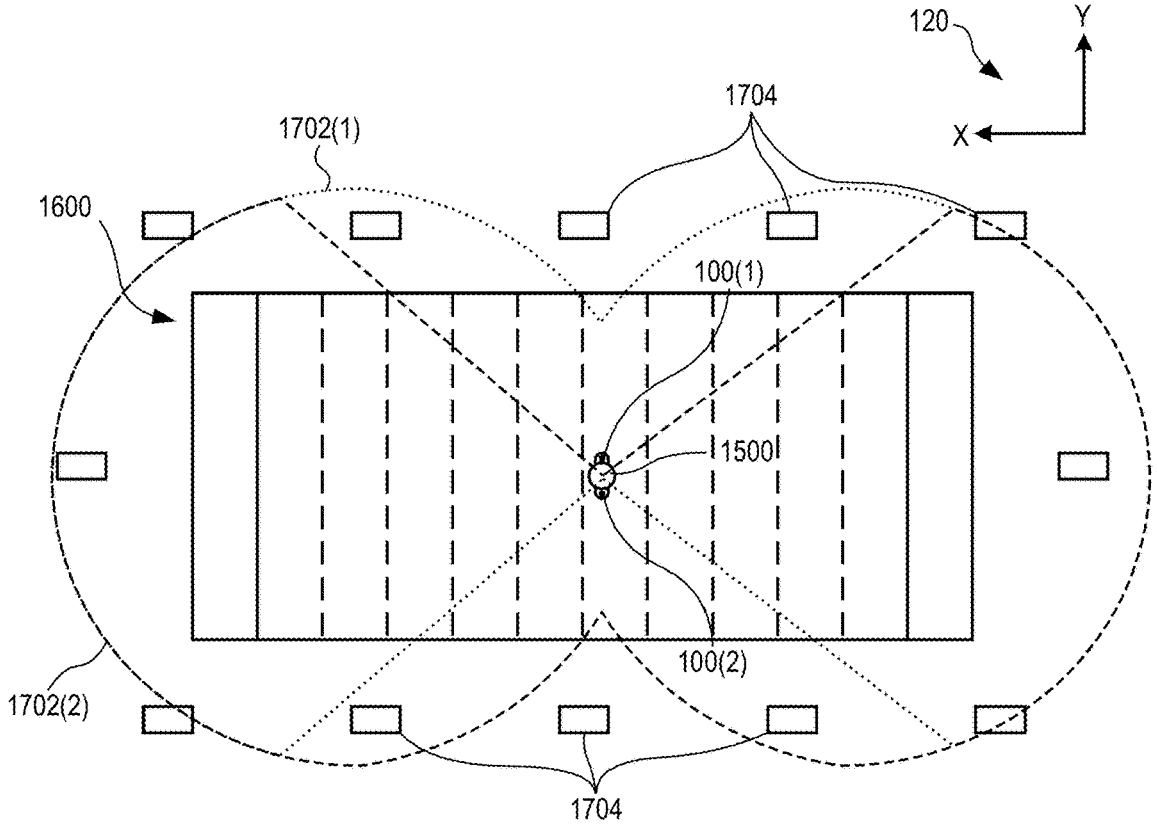

FIGS. 16 and 17 show example propagation of transmissions 1702(1) and 1702(2) from nonplanar tracking tags 100(1) and 100(2) configured with the player of FIG. 15 on an American football field 1600. Plays on football field 1600 are generally up or down the football field 1600 (e.g., along the x direction, see coordinate axes 120), as opposed to across football field 1600 (e.g., along the y direction). Thus, players in general are also facing up and down the length of football field 1600. As shown in FIG. 17, football field 1600 is surrounded by a plurality of receivers 1704 (also known as anchors) that are configured to receive transmissions from nonplanar tracking tags 100(1), 100(2). The locations of receivers 1704 and received transmissions 1702(1), 1702(2) are used to determine the location of nonplanar tracking tags 100(1), 100(2) within the operational area that includes football field 1600. At least three receivers 1704 are required to receive a particular transmission to enable location of the corresponding nonplanar tracking tag 100.

Transmissions 1702 correspond to radiation pattern 400 of FIG. 4, and also illustrate blockage by the body of player 1500. Positioning and orientation of nonplanar tracking tags 100(1), 100(2) partially determines the shape of transmissions 1702(1), 1702(2), and its effectiveness at being received by receivers 1704. By configuring antenna patches 102(1), 102(2) such that more power is transmitted in the directions away from the player (e.g., base 101 faces toward a shoulder of player 1500, and top panel 106 faces away from player 1500), less power is absorbed by the player's body.

Positioning and orientation of nonplanar tracking tags 100(1), 100(2) also partially determines the effectiveness of transmissions 1702(1), 1702(2) being received by receivers 1704. Since football field 1600 is longer in the x direction than it is wide in the y direction, more receivers 1704 receive each transmission 1702(1), 1702(2).

The advantages of nonplanar tracking tag 100 may be used to track other players and objects and used with other sports without departing from the scope hereof. Although the embodiments described above and shown in the figures have two antenna patches, further embodiments are envisioned where multiple antenna patches are coupled together in one or both of serial and parallel configurations.

Changes may be made in the above methods and systems without departing from the scope hereof. It should thus be noted that the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall therebetween. In particular, the following embodiments are specifically contemplated, as well as any combinations of such embodiments that are compatible with one another:

(A) A nonplanar complementary patch antenna, including an antenna ground plane; a first antenna patch in a first plane forming a first angle with the antenna ground plane; and a second antenna patch in a second plane forming a second angle with the antenna ground plane.

(B) In the nonplanar complementary patch antenna denoted as (A), the antenna ground plane being positioned beneath the first and second antenna patches.

(C) In either of the nonplanar complementary patch antennae denoted as (A) or (B), an intersection of the first and second planes being parallel to the antenna ground plane and on the same side of the antenna ground plane as the first and second antenna patches.

(D) In any of the nonplanar complementary patch antennae denoted as (A)-(C), the first and second antenna patches having first and second geometries, respectively, selected to generate a radiation pattern for a wirelessly transmitted ultra-wideband (UWB) signal.

(E) In any of the nonplanar complementary patch antennae denoted as (A)-(D), the first and second geometries being similar, and the first and second angles being similar.

(F) In any of the nonplanar complementary patch antennae denoted as (A)-(E), the first and second geometries being rectangular.

(G) A nonplanar complementary patch antenna, including a flexible substrate formed with first and second antenna patches and corresponding first and second balanced feed lines, the flexible substrate being configured for forming around a dielectric material having a geometry to position the first and second antenna patches in first and second planes, respectively, that form first and second angles, respectively, with an antenna ground plane.

(H) In the nonplanar complementary patch antenna denoted as (G), the antenna ground plane being positioned beneath the first and second antenna patches.

(I) In either of the nonplanar complementary patch antennae denoted as (G) or (H), an intersection of the first and second planes being parallel to the antenna ground plane and on the same side of the antenna ground plane as the first and second antenna patches.

(J) In any of the nonplanar complementary patch antenna denoted as (G)-(I), the first and second antenna patches having first and second geometries, respectively, selected to generate a radiation pattern for a wirelessly transmitted UWB signal.

(K) In any of the nonplanar complementary patch antenna denoted as (G)-(J), the first and second geometries being similar, and the first and second angles being similar.

(L) In any of the nonplanar complementary patch antenna denoted as (G)-(K), the first and second geometries being rectangular.

(M) A nonplanar tracking tag, comprising a flexible circuit having: a first antenna patch formed at a first end of the flexible circuit; a second antenna patch formed at a second end, opposite the first end, of the flexible circuit; and a transceiver circuit electrically coupled to the first and second antenna patches; a battery; and a dielectric material having a shape and size to position the first and second antenna patches, when the flexible circuit is wrapped around the dielectric material, in first and second planes, respectively, that form first and second angles, respectively, with an antenna ground plane.

(N) In the nonplanar tracking tag denoted as (M), the first and second antenna patches having first and second geometries, respectively, selected to generate a radiation pattern for a wirelessly transmitted UWB signal.

(O) In either of the nonplanar tracking tags denoted as (M) or (N), the battery being flexible.

(P) In any of the nonplanar tracking tags denoted as (M)-(0), the battery being a rechargeable battery, and the flexible circuit further having a charging regulator circuit electrically connected to the rechargeable battery and an external power connector.

(Q) In any of the nonplanar tracking tags denoted as (M)-(P), the battery being enclosed in a metal case, a position and geometry of the battery being chosen such that the metal case serves as the antenna ground plane.

(R) In any of the nonplanar tracking tags denoted as (M)-(Q), the flexible circuit further having a microprocessor circuit electrically coupled to the transceiver circuit.

(S) In any of the nonplanar tracking tags denoted as (M)-(R), an intersection of the first and second planes being parallel to the antenna ground plane and on the same side of the antenna ground plane as the first and second antenna patches.

(T) In any of the nonplanar tracking tags denoted as (M)-(S), wherein seams formed when the flexible circuit is wrapped around the dielectric material are sealed to make the nonplanar tracking tag waterproof.

What is claimed is:

1. A nonplanar complementary patch antenna, comprising:

a base;

an antenna ground plane located on the base;

a first patch panel that connects to the base;

a first antenna patch located on the first patch panel and having a first plurality of antenna-patch edges, the first antenna patch forming a first acute angle with the antenna ground plane;

a second patch panel that connects to the base;

a second antenna patch located on the second patch panel and having a second plurality of antenna-patch edges, the second antenna patch forming a second acute angle with the antenna ground plane;

a first feedline located on both the base and the first patch panel, the first feedline electrically connecting to a first closest edge, of the first plurality of antenna-patch edges, that is closest to the antenna ground plane; and a second feedline located on both the base and the second patch panel, the second feedline electrically connecting to a second closest edge, of the second plurality of antenna-patch edges, that is closest to the antenna ground plane, the second feedline being electrically isolated from the first feedline;

wherein (i) the first closest edge couples more strongly to the antenna ground plane than a first farthest edge, of the first plurality of antenna-patch edges, that is farthest from the antenna ground plane and (ii) the second closest edge couples more strongly to the antenna ground plane than a second farthest edge, of the second plurality of antenna-patch edges, that is farthest from the antenna ground plane.

2. The nonplanar complementary patch antenna of claim 1, the antenna ground plane being positioned beneath the first and second antenna patches.

3. The nonplanar complementary patch antenna of claim 2, wherein:

the first antenna patch lies in a first plane;

the second antenna patch lies in a second plane; and an intersection of the first and second planes is parallel to the antenna ground plane and on the same side of the antenna ground plane as the first and second antenna patches.

4. The nonplanar complementary patch antenna of claim 1, the first and second antenna patches having first and second geometries, respectively, selected to generate a radiation pattern for a wirelessly transmitted ultra-wideband signal.

5. The nonplanar complementary patch antenna of claim 4, the first and second geometries being similar, and the first and second acute angles being similar.

6. The nonplanar complementary patch antenna of claim 5, the first and second geometries being rectangular.

7. The nonplanar complementary patch antenna of claim 1, wherein:

the first patch panel connects to a first base edge of the base;

the first feedline crosses the first base edge to electrically connect to the first antenna patch;

the second patch panel connects to a second base edge of the base that is opposite to the first base edge; and the second feedline crosses the second base edge to electrically connect to the second antenna patch.

8. The nonplanar complementary patch antenna of claim 1, wherein:

the first patch panel connects to a first base edge of the base;

the second patch panel connects to a second base edge of the base that is opposite to the first base edge; and the base, the first patch panel, and the second patch panel are formed from a single flexible substrate that is folded at the first base edge and at the second base edge.

9. The nonplanar complementary patch antenna of claim 1, wherein:

the first patch antenna is located on an inner face of the first patch panel; and the second patch antenna is located on an inner face of the second patch panel.

10. The nonplanar complementary patch antenna of claim 1, further comprising a top panel that connects to both of the first and second patch panels.

11. The nonplanar complementary patch antenna of claim 10, the top panel being parallel to the base.

12. The nonplanar complementary patch antenna of claim 10, further comprising:

a first side panel connected to the base, the first patch panel, the second patch panel, and the top panel; and a second side panel connected to the base, the first patch panel, the second patch panel, and the top panel.

13. The nonplanar complementary patch antenna of claim 10, further comprising a dielectric material between the base and the top panel.

14. The nonplanar complementary patch antenna of claim 13, the dielectric material being shaped to mechanically support each of the first and second patch panels.

15. The nonplanar complementary patch antenna of claim 12, wherein the base, the first patch panel, the second patch panel, the top panel, the first side panel, and the second side panel are formed from a single flexible substrate that is folded.

* * * * *